US011168858B2

(12) United States Patent
Ohashi et al.

(10) Patent No.: US 11,168,858 B2
(45) Date of Patent: Nov. 9, 2021

(54) VEHICULAR LAMP

(71) Applicant: Ichikoh Industries, Ltd., Isehara (JP)

(72) Inventors: Yuji Ohashi, Isehara (JP); Eiji Suzuki, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 17/059,758

(22) PCT Filed: May 31, 2019

(86) PCT No.: PCT/JP2019/021737
§ 371 (c)(1),
(2) Date: Nov. 30, 2020

(87) PCT Pub. No.: WO2019/230953
PCT Pub. Date: Dec. 5, 2019

(65) Prior Publication Data

US 2021/0231279 A1 Jul. 29, 2021

(30) Foreign Application Priority Data

Jun. 1, 2018 (JP) ..... JP2018-106119
Jun. 1, 2018 (JP) ..... JP2018-106120

(51) Int. Cl.
*F21S 41/265* (2018.01)
*F21S 41/33* (2018.01)
(Continued)

(52) U.S. Cl.
CPC ..... *F21S 41/265* (2018.01); *F21S 41/148* (2018.01); *F21S 41/151* (2018.01); *F21S 41/24* (2018.01); *F21S 41/333* (2018.01); *F21S 41/40* (2018.01)

(58) Field of Classification Search
CPC ..... F21S 41/151; F21S 41/40; F21S 41/148; F21S 41/333; F21S 41/24; F21S 41/265
See application file for complete search history.

(56) References Cited

U.S. PATENT DOCUMENTS

2009/0310353 A1 12/2009 Inaba
2014/0268846 A1* 9/2014 Nakazato ..... F21S 41/176 362/510
(Continued)

FOREIGN PATENT DOCUMENTS

JP 2009-301980 A 12/2009
JP 2016-39021 A 3/2016
(Continued)

OTHER PUBLICATIONS

International Search Report dated Jul. 23, 2019 in PCT/JP2019/021737 filed on May 31, 2019, 1 page.

*Primary Examiner* — Anne M Hines
(74) *Attorney, Agent, or Firm* — Oblon, McClelland, Maier & Neustadt, L.L.P.

(57) ABSTRACT

A vehicular lamp includes a first light source that emits light forming a passing light distribution pattern; a second light source that is disposed forward of the first light source and emits light forming a traveling light distribution pattern; a reflector that reflects the light from the first and the second light sources; a first lens that projects the light reflected forward by the reflector; and a second lens that transmits the light from the second light source toward the reflector. The second light source and the first light source are disposed on the same plane. The reflector has first and second reflective surfaces. The first reflective surface reflects the light from the first light source to the first lens. The second reflective surface is disposed forward of the first reflective surface and reflects the light from the second light source through the second lens to the first lens.

9 Claims, 6 Drawing Sheets

(51) Int. Cl.

| | |
|---|---|
| ***F21S 41/151*** | (2018.01) |
| ***F21S 41/24*** | (2018.01) |
| ***F21S 41/148*** | (2018.01) |
| ***F21S 41/40*** | (2018.01) |

(56) References Cited

U.S. PATENT DOCUMENTS

| | | | | |
|---|---|---|---|---|
| 2014/0340922 | A1* | 11/2014 | Matsumoto | F21S 45/43 362/516 |
| 2015/0219301 | A1* | 8/2015 | Honda | F21S 41/255 362/517 |
| 2015/0260366 | A1* | 9/2015 | Youn | F21S 41/692 362/512 |
| 2017/0227184 | A1 | 8/2017 | Ishida et al. | |
| 2017/0343173 | A1 | 11/2017 | Takada et al. | |

FOREIGN PATENT DOCUMENTS

| | | | |
|---|---|---|---|
| JP | 2016-39110 | A | 3/2016 |
| JP | 2017-212170 | A | 11/2017 |
| JP | 2018-37298 | A | 3/2018 |

* cited by examiner

VEHICULAR LAMP

TECHNICAL FIELD

The present invention relates to a vehicular lamp.

BACKGROUND ART

A vehicular lamp uses light from a light source to form predetermined light distribution patterns.

There is such a known vehicular lamp that forms a passing light distribution pattern with light from a first light source and a traveling light distribution pattern with light from a second light source (for example, refer to PLT 1, etc.). In such a vehicular lamp, light emitted from a first light source and reflected by a reflector and light emitted from a second light source disposed in front of the first light source and guided by a translucent member are emitted forward from the vehicle by a projection lens, to form a passing light distribution pattern and a traveling light distribution pattern disposed side by side vertically. With such a vehicular lamp, in order to efficiently use the light emitted from the first light source disposed behind the second light source and reflected by the reflector, the reflector and the projection lens are arranged such that light traveling between the reflector and the projection lens is not interfere, except for intentional shading by a shade.

CITATION LIST

Patent Literature

PTL 1: Japanese Unexamined Patent Publication No. 2016-39110

SUMMARY OF THE INVENTION

Problems to be Solved by the Invention

However, in a conventional vehicular lamp, the light emitted from the second light source is guided to the projection lens by the translucent member by reflecting the light to the projection lens by a reflective surface provided inside the translucent member. Therefore, the translucent member has to be large. For this reason, in a conventional vehicular lamp, the first light source and the second light source are disposed at different levels such that the second light source is disposed below the first light source. Accordingly, in such a conventional vehicular lamp, the shapes of the members to which the first light source and the second light source are attached are complicated, and separate substrates have to be provided for the first light source and the second light source.

An object of the present disclosure, which has been made in view of the above circumstances, is to provide a vehicular lamp in which a first light source and a second light source can be provided without a different in levels while a passing light distribution pattern and a traveling light distribution pattern can be formed in an overlapping manner.

Means for Solving the Problem

A vehicular lamp according to the disclosure includes a first light source that emits light forming a passing light distribution pattern; a second light source that is disposed forward of the first light source in an optical axis direction and emits light forming a traveling light distribution pattern; a reflector that reflects the light emitted from the first light source and the second light source; a first lens that projects the light reflected forward in the optical axis direction by the reflector; and a second lens that transmits the light emitted from the second light source toward the reflector. The second light source is disposed on the same plane as the first light source. The reflector has a first reflective surface and a second reflective surface. The first reflective surface reflects the light emitted from the first light source to the first lens. The second reflective surface is disposed forward of the first reflective surface in the optical axis direction and reflects the light emitted from the second light source through the second lens to the first lens.

Effect of the Invention

According to a vehicular lamp of the disclosure, a first light source and a second light source can be disposed without a different in levels while a passing light distribution pattern and a traveling light distribution pattern are formed in an overlapping manner.

MODE FOR CARRYING OUT THE INVENTION

A vehicular lamp 10 according to a first embodiment will now be described as an embodiment of a vehicular lamp according to the disclosure with reference to FIGS. 1 to 3.

First Embodiment

The vehicular lamp 10 is used as a lamp for a vehicle, such as an automobile, and, for example, is used as a headlamp or a fog lamp. The vehicular lamp 10 is disposed on each of right and left sides of a front portion of the vehicle. The vehicular lamp 10 is disposed in lamp chamber composed of a lamp housing having an opened front covered with an outer lens. The vehicular lamp 10 is disposed in the lamp changer via a vertical-direction optical axis adjustment mechanism and a width-direction optical axis adjustment mechanism. In description below, in the vehicular lamp 10, the direction in which the vehicle travels straight and light is emitted is defined as the optical axis direction; the vertical direction of the vehicular lamp 10 mounted on the vehicle defined as the vertical direction; and the direction orthogonal to the optical axis direction and the vertical direction is defined as the width direction.

Figure 1:
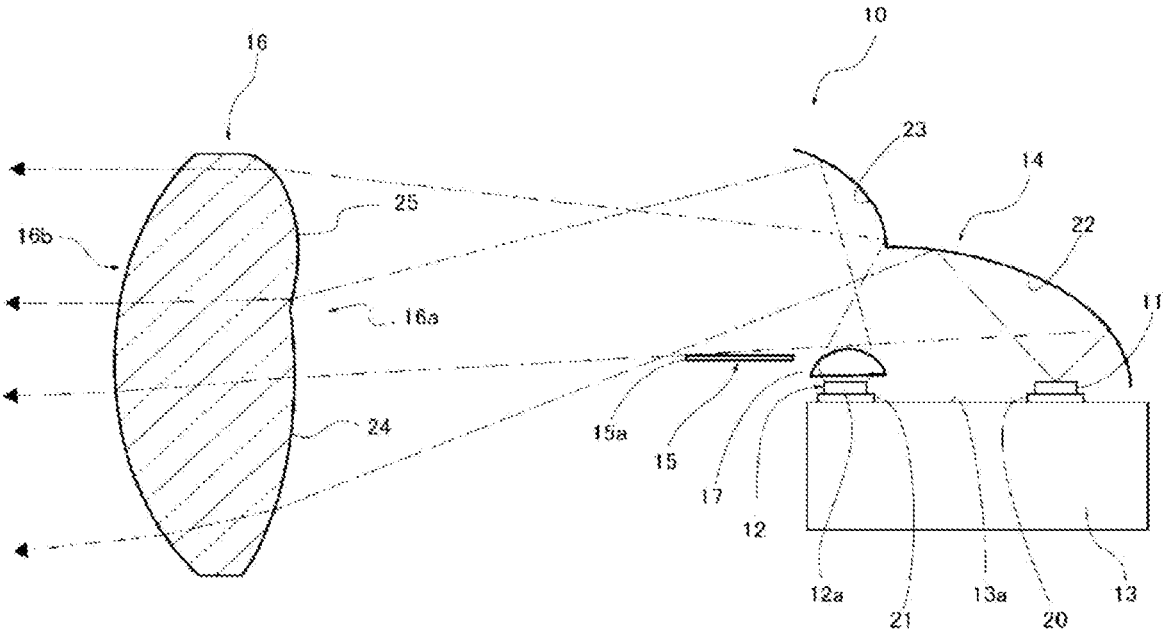
FIG. 1 is a diagram illustrating the configuration of a vehicular lamp as an example according to an embodiment of a vehicular lamp according to the disclosure.

As illustrated in FIG. 1, the vehicular lamp 10 includes a first light source 11, a second light source 12, a heat sink member 13, a reflector 14, a shade 15, a first lens 16, and a second lens 17, to constitute a projector-type front lamp unit.

The first light source 11 includes a light emitting element, such as a light emitting diode (LED), and is mounted on a substrate 20. The substrate 20 is fixed to an upper surface 13*a* of the heat sink member 13. The first light source 11 is appropriately lit by receiving electric power from a lighting control circuit.

The second light source 12 includes a light emitting element, such as an LED, and is mounted on a substrate 21 forward of the first light source 11 in the optical axis direction (in the direction of light emission from the vehicular lamp 10). The substrate 21 is fixed forward of the substrate 20 in the optical axis direction to the upper surface 13*a* of the heat sink member 13. Consequently, the second light source 12 is disposed on the same plane as the first light source 11. The second light source 12 is appropriately lit by receiving electric power from a lighting control circuit. The second light source 12 of the first embodiment includes five light source units 12*a* (FIG. 1 illustrates only the one at the front) aligned in the width direction on the substrate 21. Each of the light source units 12*a* includes a light emitting element and is appropriately lit all at once or individually by receiving electric power from a lighting control circuit. Note that the configuration of the light source units 12*a* is not limited to that of the first embodiment, and the number of the light source units 12*a* may be appropriately set.

The heat sink member 13 is a heat radiating member that releases heat generated at the first light source 11 and the second light source 12 to the outside. The substrate 20 and the substrate 21 are disposed on the upper surface 13*a* of the heat sink member 13. The reflector 14 is disposed on the upper surface 13*a* so as to cover both the substrates (20, 21). The upper surface 13*a* of the heat sink member 13 of the first embodiment on which the first light source 11 and the second light source 12 are disposed via the respective substrates (20, 21) is disposed below the physical center position of the first lens 16 (the center line of the emission surface 16*b* described later) in the vertical direction. In this way, light beams having high intensity can be effectively used among the light beams emitted from the first light source 11 and the second light source 12 disposed on the upper surface 13*a*.

The reflector 14 is attached to the heat sink member 13 (the upper surface 13*a*) so as to cover the substrate 20 and the substrate 21, that is, the first light source 11 and the second light source 12 mounted on the respective substrates. The reflector 14 has a first reflective surface 22 and a second reflective surface 23 facing the upper surface 13*a*. The first reflective surface 22 is provided to reflect the light emitted from the first light source 11 to the first lens 16. The first reflective surface 22 is a freeform surface based on an ellipse in which the first focus is the first light source 11 and the second focus resides in the vicinity of a leading edge 15*a* of the shade 15 described below. The first reflective surface 22 forms a passing light distribution pattern LP (see FIG. 2) by reflecting the light from the first light source 11 forward and emitting the light through the first lens 16.

The second reflective surface 23 is provided to reflect the light emitted from the second light source 12 through the second lens 17 to the first lens 16 as described below. The second reflective surface 23 is a freeform surface based on an ellipse having a first focus in the vicinity of the focal point of the second lens 17 and a second focus that resides at a point that is substantially the same distance to the first lens 16 as the rear focal point of the first lens 16 and in the vicinity of the rear focal point of an upper lens surface 25 described below. The light from the second light source 12 is focused by the second lens 17 as described below, reflected forward by the second reflective surface 23, and emitted through the first lens 16, to form a traveling light distribution pattern HP (see FIG. 2).

The shade 15 is disposed on the heat sink member 13. The shade 15 has a plate shape orthogonal to the vertical direction and extending in the width direction. The leading edge 15*a* at the front of the shade 15 in the optical axis direction has a shape in which two horizontal edges at different positions in the optical axis direction are joined by a tilt edge. The leading edge 15*a* of the shade 15 blocks a portion of the light emitted from the first light source 11 and reflected by the first reflective surface 22 of the reflector 14, to form a cutoff line Cl (see FIG. 2) at the upper edge of the passing light distribution pattern LP described below. The cutoff line Cl is formed by connecting two horizontal lines with a tilt line.

Figure 2:
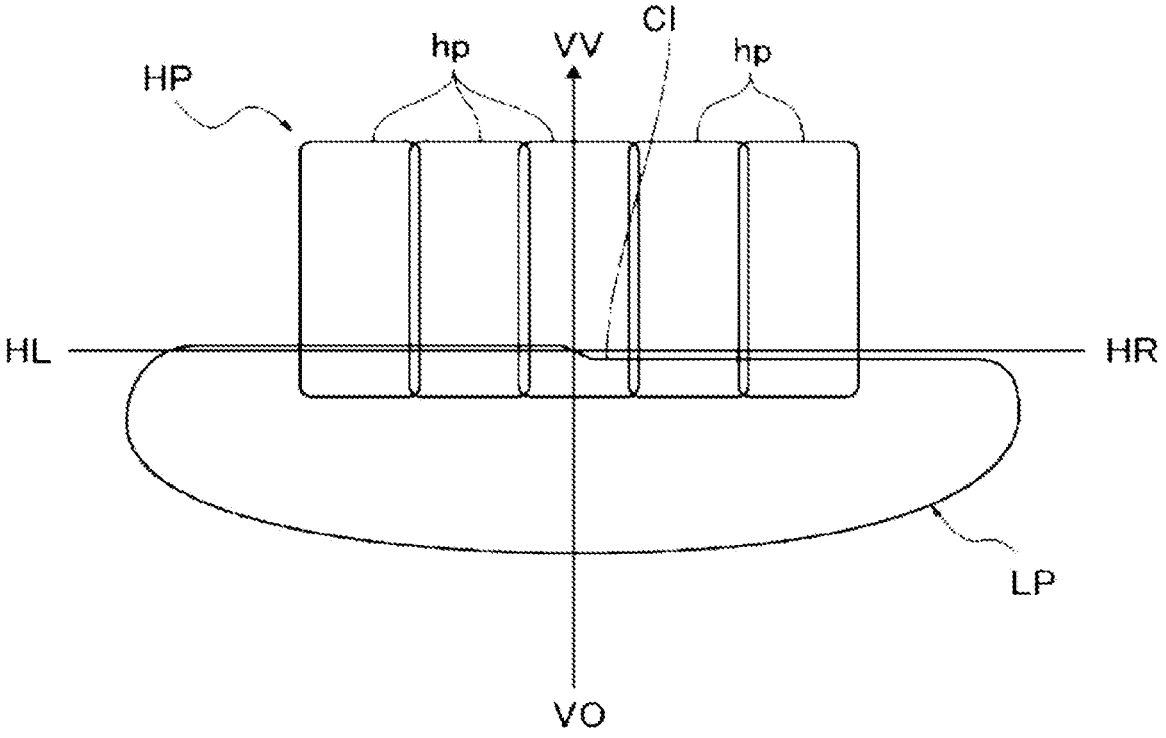
FIG. 2 is a diagram illustrating a traveling light distribution pattern and a passing light distribution pattern.
Figure 3:
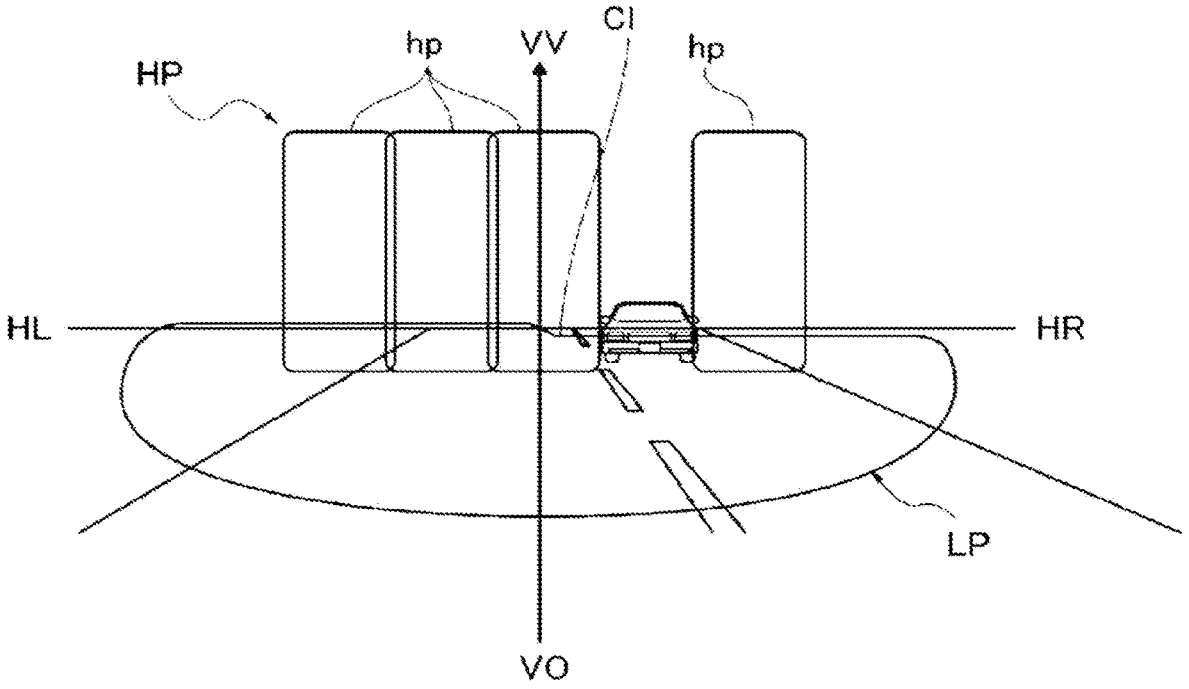
FIG. 3 is a diagram similar to FIG. 2 illustrating a state in which one of traveling light distribution sections is turned off in a traveling light distribution pattern.

The first lens 16 projects the light reflected by the first reflective surface 22 of the reflector 14 forward from the vehicle, to form the passing light distribution pattern LP (see FIG. 2). The first lens 16 also projects the light reflected by the second reflective surface 23 of the reflector 14 forward from the vehicle, to form the traveling light distribution pattern HP (see FIG. 2).

The first lens 16 of the first embodiment has a lower lens surface 24 and an upper lens surface 25 on an incident surface 16*a* adjacent to the first light source 11 and the second light source 12, i.e., on the rearward side in the optical axis direction. The lower lens surface 24, where the light reflected by the first reflective surface 22 of the reflector 14 is incident, forms a passing light distribution pattern LP (see FIG. 2) in cooperation with an emission surface 16*b* on forward side of the first lens 16 in the optical axis direction. The lower lens surface 24 sets the rear focal point of the lower portion of the first lens 16 near the leading edge 15*a* of the shade 15. The lower portion of the first lens 16 is defined by the lower lens surface 24 and a section of the emission surface 16*b* facing the lower lens surface 24.

The upper lens surface 25, where the light reflected by the second reflective surface 23 is incident, forms a traveling light distribution pattern HP (see FIG. 2) in cooperation with the emission surface 16*b* of the first lens 16. The upper lens surface 25 sets the rear focal point of the upper portion of the first lens 16 near the second focus of the second reflective surface 23. The upper portion of the first lens 16 is defined by the upper lens surface 25 and a section of the emission surface 16*b* facing the upper lens surface 25.

The upper lens surface 25 of the first embodiment has fine rhombic embossments (microstructures). As a result, the light from the second light source 12 and reflected by the second reflective surface 23 is diffused by the upper lens surface 25 in the vertical direction. As a result, the upper lens surface 25 evens out the light intensity in the traveling light distribution pattern HP while enlarging the traveling light distribution pattern HP in the vertical direction. Note that the configuration of the embossments is not limited to that of the first embodiment, and the shape, the range, the number, and the size of the embossments may be appropriately set as long as the embossments diffuse the light from the second light source 12 in the vertical direction. Alternatively, the embossments may be disposed on the emission surface 16*b* facing the second reflective surface 23. Moreover, the configuration of the embossments is not limited to that of the first embodiment in that the embossments may also be appropriately disposed on the lower lens surface 24 if required by the passing light distribution pattern LP. Alternatively, the embossments may be disposed on the emission surface 16*b* facing the first reflective surface 22.

The first lens 16 is supported by a lens holder. The lens holder is mounted to the heat sink member 13 while the first lens 16 is positioned relative to the first light source 11, the second light source 12, the reflector 14, the shade 15, and the second lens 17.

The second lens 17 focuses the light emitted from the second light source 12 and transmits the light to the second reflective surface 23 of the reflector 14. The second lens 17 of the first embodiment is formed of a cylindrical lens extending in the width direction and having a refractive power only in the optical axis direction, to correspond to the five light source units 12*a* of the second light source 12. The second lens 17 is disposed on the heat sink member 13. The second lens 17 is one that has a focus line extending in the width direction along the five light source units 12*a*. The second lens 17 focuses the light emitted from each of the light source units 12*a* (the second lens 17) in the optical axis direction and transmits the light to the second reflective surface 23. Note that the configuration of the second lens 17 is not limited to that of the first embodiment as long as the second lens 17 transmits the light emitted from the second light source 12 to the second reflective surface 23.

The vehicular lamp 10 appropriately lights the first light source 11 by supplying electric power from the lighting control circuit to the first light source 11 via the substrate 20. Upon this lighting, in the vehicular lamp 10, the light from the first light source 11 is reflected by the first reflective surface 22 of the reflector 14 and is emitted from the first lens 16 through the lower lens surface 24, to form a passing light distribution pattern LP (see FIG. 2) having a cutoff line Cl at the upper edge.

The vehicular lamp 10 appropriately lights the second light source 12 (each of the light source units 12*a*) by supplying electric power from the lighting control circuit to each light source unit 12*a* of the second light source 12 via the substrate 21. Upon this lighting, in the vehicular lamp 10, the light from the second light source 12 is focused by the second lens 17, is reflected by the second reflective surface 23 of the reflector 14, and is emitted from the first lens 16 via the upper lens surface 25, to form a traveling light distribution pattern HP (see FIG. 2) so that its lower edge portion overlaps with the upper edge portion of the passing light distribution pattern LP.

The vehicular lamp 10 of the first embodiment is an adaptive driving beam (ADB). When the five light source units 12*a* of the second light source 12 are turned on, the light from each light source unit 12*a* forms a traveling light distribution section hp (see FIG. 2). The five traveling light distribution sections hp are integrally formed side by side in the width direction to form the traveling light distribution pattern HP (see FIG. 2). The vehicular lamp 10 individually turns on and off the light source units 12*a* of the second light source 12 to partially turn off the five traveling light distribution sections hp in a specific direction (See FIG. 3). As a result, the vehicular lamp 10 can partially turn off the traveling light distribution pattern HP in any direction by individually turning on and off the light source units 12*a*.

Consequently, the vehicular lamp 10 can form the passing light distribution pattern LP having the cutoff line Cl by turning on the first light source 11 and form the traveling light distribution pattern HP by turning on the light source units 12*a* of the second light source 12 (see FIG. 2). The vehicular lamp 10 performs the lighting control of the first light source 11 and each of the light source units 12*a* of the second light source 12, to appropriately form at least one of the passing light distribution pattern LP and the traveling light distribution pattern HP. The vehicular lamp 10 turns off a light source unit 12*a* residing in any direction among the light source units 12*a* of the second light source 12 and thereby a traveling light distribution section hp in the corresponding direction is not formed. In this way, the vehicular lamp 10 can realize the function of the ADB (see FIG. 3).

As described above, in the vehicular lamp 10, the second lens 17 disposed above the second light source 12 focuses light only from the second light source 12, and the second reflective surface 23 of the reflector 14 disposed above the second lens 17 reflects the light toward the first lens 16. Consequently, in the vehicular lamp 10, the second lens 17 does not have to reflect the light from the second light source 12 toward the first lens 16, like the translucent member of the related art, and thus, the second lens 17 can be small. As a result, in the vehicular lamp 10, even when the second light source 12 is disposed at the same position (on the same plane) in the vertical direction as the first light source 11, the second lens 17 can be prevented from hindering the advancement of the light emitted from the first light source 11 and reflected to the first lens 16 by the first reflective surface 22 of the reflector 14. Therefore, in the vehicular lamp 10, the area in which the first light source 11 and the second light source 12 are attached (the upper surface 13*a* in the first embodiment) can be made flat; the member to which the first light source 11 and the second light source 12 are attached (the heat sink member 13 in the first embodiment) can be made to have a simple shape; and the first light source 11 and the second light source 12 can be disposed on the same plane. Note that, the substrate 20 and the substrate 21, which are disposed on the upper surface 13*a* on the same plane, may be integrated into a single substrate.

In particular, in the vehicular lamp 10 of the first embodiment, the first light source 11 and the second light source 12 are attached to the heat sink member 13 via the substrate 20 and the substrate 21, respectively. In general, heat is transferred radially from a heat source in a heat sink. Therefore, the cooling capability of the heat sink can be enhanced if it includes a large-volume spherical portion that is concentric with the heat source. In the vehicular lamp 10, the upper surface 13*a* of the heat sink member 13 is flat. Therefore, compared to when the upper surface 13*a* has a step-like structure, large-volume concentric spherical portions can be readily provided below the first light source 11 and the second light source 12 without any missing parts due to the step-like structure. Consequently, the heat sink member 13 of the vehicular lamp 10 can have a sufficient volume for transferring heat from both the first light source 11 and the second light source 12. In this way, the first light source 11 and the second light source 12 can be appropriately cooled.

In the vehicular lamp 10, the incident surface 16*a* of the first lens 16 has a lower lens surface 24 and an upper lens surface 25. The lower lens surface 24 corresponds to the light reflected by the first reflective surface 22. The upper lens surface 25 corresponds to the light reflected by the second reflective surface 23. Consequently, the vehicular lamp 10 can form the passing light distribution pattern LP and the traveling light distribution pattern HP in an overlapping manner, while the flexibility of the positional relationship between the optical path of the light reflected by the first reflective surface 22 and the optical path of the light reflected by the second reflective surface 23 is enhanced between the first lens 16 and the reflector 14. Unlike this, in the conventional art, if the incident surface 16*a* of the first lens 16 is a single surface, the two light distribution patterns (LP and HP) do not overlap with each other unless the optical path for the formation of the passing light distribution pattern LP and the optical path for the formation of the traveling light distribution pattern HP approach each other in the vicinity of the rear focal point of the first lens 16.

The vehicular lamp 10 of the first embodiment can achieve each of the following effects.

In the vehicular lamp 10, the first reflective surface 22 and the second reflective surface 23 are disposed on the reflector 14. The first reflective surface 22 reflects the light emitted from the first light source 11 to the first lens 16. The second reflective surface 23 reflects the light emitted from the second light source 12 to the first lens 16 through the second lens 17. In this way, in the vehicular lamp 10, the second lens 17 has a function of transmitting the light from the second light source 12 to the second reflective surface 23, and the second reflective surface 23 has a function of reflecting the light toward the first lens 16. As a result, in the vehicular lamp 10, the second lens 17 can be small, and even when the first light source 11 and the second light source 12 are disposed at the same position (on the same plane) in the vertical direction, the second lens 17 can prevented from hindering the advancement of the light emitted from the first light source 11 and reflected to the first lens 16 by the first reflective surface 22. As a result, in the vehicular lamp 10, the member to which the first light source 11 and the second light source 12 are attached can have a simple shape. In the vehicular lamp 10, the first light source 11 and the second light source 12 may alternatively be disposed on a common substrate in which the substrate 20 and the substrate 21 are integrated.

In the vehicular lamp 10, the first light source 11 and the second light source 12 are disposed on the upper surface 13*a* of the heat sink member 13. Consequently, the upper surface 13*a* does not have to have a step-like structure, and thus the vehicular lamp 10 can appropriately cool the first light source 11 and the second light source 12.

In the vehicular lamp 10, the first lens 16 has the lower lens surface 24 and the upper lens surface 25. The light reflected by the first reflective surface 22 enters the lower lens surface 24. The light reflected by the second reflective surface 23 is enters the upper lens surface 25. Consequently, the vehicular lamp 10 can form the passing light distribution pattern LP and the traveling light distribution pattern HP in an overlapping manner, while the flexibility of the positional relationship between the optical path of the light reflected by the first reflective surface 22 and the optical path of the light reflected by the second reflective surface 23 is enhanced between the first lens 16 and the reflector 14.

In the vehicular lamp 10, the light from the light source units 12*a* of the second light source 12 form respective traveling light distribution sections hp aligned in the width direction to form the traveling light distribution pattern HP. Therefore, in the vehicular lamp 10, the light source units 12*a* of the second light source 12 are appropriately cooled and individually turned on and off, to partially turn off a traveling light distribution section hp in a specific direction among the multiple traveling light distribution sections hp. This realizes a more appropriately ADB function.

In the vehicular lamp 10, the second lens 17 is formed of a cylindrical lens extending in the width direction and having a refractive power only in the optical axis direction. Therefore, the vehicular lamp 10 can form the traveling light distribution sections hp being aligned in the width direction with the light from the light source units 12*a* with a simple configuration, and can form the traveling light distribution pattern HP having an ADB function.

Therefore, the vehicular lamp 10 of the first embodiment serving as a vehicular lamp 10 according to the disclosure can form the passing light distribution pattern LP and the traveling light distribution pattern HP in an overlapping manner while the first light source 11 and the second light source 12 are disposed without a difference in level.

Although the vehicular lamp of the disclosure has been described on the basis of the first embodiment, the specific configuration is not limited to that of the first embodiment, and design changes and additions are allowed without deviation from the gist of the invention according to each claim of the invention.

Note that, in the first embodiment, the ADB function can be realized by not forming a certain traveling light distribution section hp in the traveling light distribution pattern HP. However, the configuration of the vehicular lamp 10 is not limited to that of the first embodiment as long as the vehicular lamp 10 forms the passing light distribution pattern LP with the light from the first light source 11 reflected by the first reflective surface 22 of the reflector 14, and forms the traveling light distribution pattern HP with the light from the second light source 12 reflected by the second reflective surface 23 of the reflector 14.

In the first embodiment, the second lens 17 is a cylindrical lens. However, the configuration of the second lens 17 is not limited to that of the first embodiment as long as the second lens 17 corresponds to the multiple (five in the first embodiment) light source units 12*a* of the second light source 12. In another example, multiple lenses corresponding to the respective light source units 12*a* may be provided, or a freeform lens having incident surfaces and emission surfaces designed for the respective light source units 12*a* may be provided. Individual freeform lenses may be provided for the respective light source units 12*a*, or an integrated single freeform lens corresponding to the respective light source units 12*a* may be provided.

A vehicular lamp according to a second embodiment will now be described as a vehicular lamp according to an embodiment of the disclosure with reference to FIGS. 4 to 6.

Second Embodiment

In a conventional vehicular lamp, a translucent member guides all light emitted from a second light source to a projection lens by reflecting the light to the projection lens by a reflection surface disposed inside the translucent member. Consequently, in the conventional vehicular lamp, the translucent member is large because the translucent member has to be large enough to allow a reflective surface that reflects all the light from the second light source to the projection lens to be disposed inside the translucent member. For this reason, in the conventional vehicular lamp, the first light source and the second light source are disposed at different levels such that the second light source is positioned below the first light source. Therefore, in the conventional vehicular lamp, the members to which the first light source and the second light source are attached have complicated shapes, and separate substrates have to be provided for the first light source and the second light source.

An object of the second embodiment, which has been made in view of the above circumstances, is to provide a vehicular lamp capable of forming a passing light distribution pattern and a traveling light distribution pattern in an overlapping manner while including a first light source and a second light source without a different in level.

A vehicular lamp according to the second embodiment includes a first light source that emits light forming a passing light distribution pattern; a second light source that is disposed forward of the first light source in an optical axis direction and emits light forming a traveling light distribution pattern; a reflector that reflects the light emitted from the first light source; a projection lens that projects the light reflected by the reflector forward in an optical axis direction to form the passing light distribution pattern; a shade that blocks a portion of light reflected by the reflector to form a cutoff line in the passing light distribution pattern; and a light guiding unit that is disposed below the shade and guides a portion of the light emitted from the second light source toward the projection lens. The second light source is disposed on the same plane as the first light source. The shade reflects another portion of the light emitted from the second light source toward the projection lens.

According to the second embodiment of the invention, a vehicular lamp is provided that can form a passing light distribution pattern and a traveling light distribution pattern in an overlapping manner while the first light source and the second light source disposed without a different in level. A vehicular lamp 100 according to the second embodiment includes a first light source 110, a second light source 120, a reflector 140, a projection lens 170, a shade 150, and a light guiding unit (160). The first light source 110 form a passing light distribution pattern LP. The second light source 120 forms a traveling light distribution pattern HP. The reflector 140 reflects light from the first light source 110. The projection lens 170 projects the light reflected by the reflector 140 forward in the optical axis direction and forms the passing light distribution pattern LP. The shade 150 blocks a portion of the light reflected by the reflector 140 and forms a cutoff line Cl. The light guiding unit (160) is disposed below the shade 150 and guides a portion of the light emitted from the second light source 120 toward the projection lens 170. The second light source 120 is disposed on the same plane as the first light source 110. The shade 150 reflects the other portion of the light emitted from the second light source 120 toward the projection lens 170. The vehicular lamp 100 according to the second embodiment will now be described in detail.

Since the vehicular lamp 100 of the second embodiment has the basic functions and configurations described in the vehicular lamp 10 of the first embodiment, the same functions and configurations will not be described here.

Figure 4:
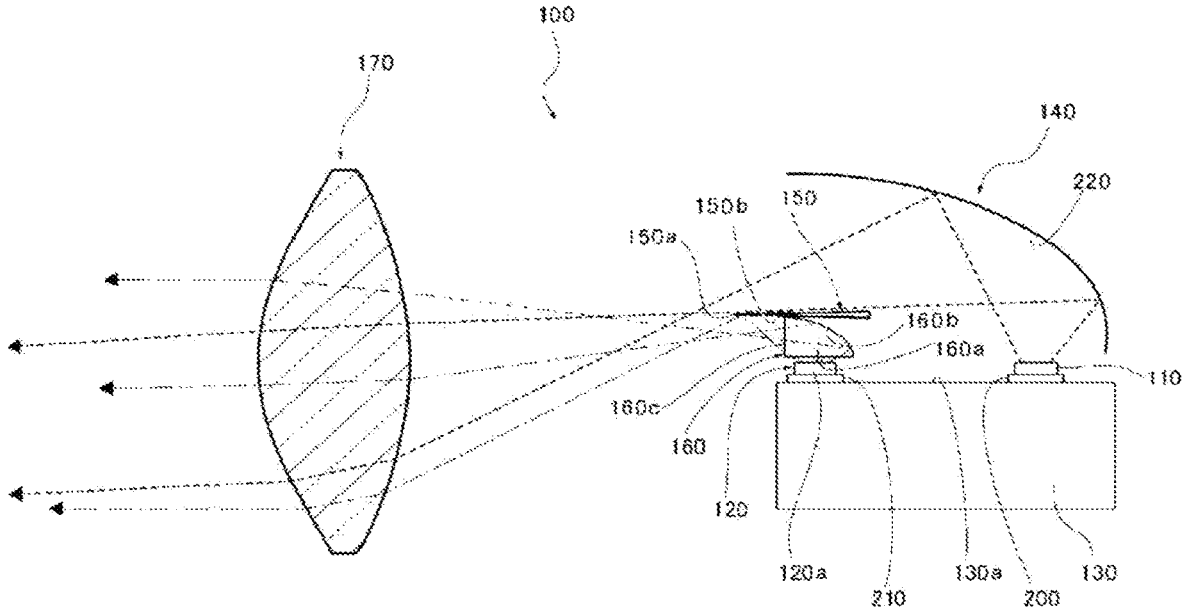
FIG. 4 is a diagram illustrating the configuration of a vehicular lamp as another example according to an embodiment of a vehicular lamp according to the disclosure.

As illustrated in FIG. 4, the vehicular lamp 100 includes a first light source 110, a second light source 120, a heat sink member 130, a reflector 140, a shade 150, an auxiliary lens 160, and a projection lens 170, to constitute a projector-type front lamp unit.

The first light source 110 includes a light emitting element, such as a light emitting diode (LED), and is mounted on a substrate 200. The substrate 200 is fixed to an upper surface 130*a* of the heat sink member 130. The first light source 110 is appropriately lit by receiving electric power from a lighting control circuit.

The second light source 120 includes a light emitting element, such as an LED, and is mounted on a substrate 210 forward of the first light source 110 in the optical axis direction (in the direction of light emission from the vehicular lamp 100). The substrate 210 is fixed forward of the substrate 200 in the optical axis direction to the upper surface 130*a* of the heat sink member 130. Consequently, the second light source 120 is disposed on the same plane as the first light source 110. The second light source 120 is appropriately lit by receiving electric power from a lighting control circuit. The second light source 120 of the second embodiment includes five light source units 120*a* (FIG. 4 illustrates only the one at the front) aligned in the width direction on the substrate 210. Each of the light source units 120*a* includes a light emitting element and is appropriately lit all at once or individually by receiving electric power from a lighting control circuit. Note that the configuration of the light source units 120*a* is not limited to that of the second embodiment, and the number of the light source units 120*a* may be appropriately set.

The heat sink member 130 is a heat radiating member that releases heat generated at the first light source 110 and the second light source 120 to the outside. The substrate 200 and the substrate 210 are disposed on the upper surface 130*a* of the heat sink member 130. The reflector 140 is disposed on the upper surface 130*a* so as to cover both the substrates (200, 210). In the heat sink member 130 of the second embodiment, the upper surface 130*a* on which the first light source 110 and the second light source 120 are disposed via the two substrates (200, 210) is disposed below the optical center position of the projection lens 170 in the vertical direction. In this way, high-intensity light of the light emitted from the first light source 110 disposed on the upper surface 130*a* can be effectively used.

The reflector 140 is attached to the heat sink member 130 (the upper surface 130*a*) so as to cover the substrate 200 and the substrate 210, that is, the first light source 110 and the second light source 120 mounted on the respective substrates. The reflector 140 has a reflective surface 220 facing the upper surface 130*a*. The reflective surface 220 is provided to reflect the light emitted from the first light source 110 to the projection lens 170. The reflective surface 220 is a freeform surface based on an ellipse in which the first focus is the first light source 110 and the second focus resides in the vicinity of a leading edge 150*a* of the shade 150 described below.

The shade 150 is disposed on the heat sink member 130. The shade 150 has a plate shape orthogonal to the vertical direction and extending in the width direction. The shade 150 of the second embodiment is tapered such that the thickness in the vertical direction decreases toward the front in the optical axis direction. The leading edge 150*a* of the shade 150 at the front in the optical axis direction is tapered (has a sharp edge) in the cross-section orthogonal to the width direction. The leading edge 150*a* has a shape in which two horizontal edges at different positions in the optical axis direction are joined by a tilt edge. The leading edge 150*a* of the shade 150 blocks a portion of the light emitted from the first light source 110 and reflected by the reflective surface 220 of the reflector 140, to form a cutoff line Cl (see FIG. 5) at the upper edge of the passing light distribution pattern LP described below. The cutoff line Cl is formed by connecting two horizontal lines with a tilt line.

The lower surface of the shade 150 in the vertical direction is a reflective surface 150*b*. The reflective surface 150*b* forms an auxiliary light distribution pattern AP as described. The reflective surface 150*b* reflects the light entering the auxiliary lens 160 from the incident surface 160*a* described below and being emitted from the emission surface 160*c* toward the projection lens 170. The reflective surface 150*b* is formed by surface-treating the lower surface of the shade 150. The surface treatment is for blurring or mainly diffusing, in the vertical direction, the auxiliary light distribution pattern AP to be formed. The surface treatment is performed so that light is diffused while being reflected. Note that the configuration of the surface treatment is not limited to that of the second embodiment, and the degree of diffusion and the reflectance may be appropriately set in accordance with the size, shape, brightness, etc. required for the auxiliary light distribution pattern AP to be formed.

The auxiliary lens 160 focuses a portion of the light emitted from the second light source 120 and transmits the light forward in the optical axis direction, that is, toward the projection lens 170. The auxiliary lens 160 of the second embodiment is composed of a colorless transparent resin material (transmissive member) that transmits light. Here, the colorless transparent material refers to a material that transmits the light emitted from the second light source 120 (each light source unit 120*a*) without causing a color change. The auxiliary lens 160 of the second embodiment is disposed as close to the shade 150 as possible in the vertical direction. The auxiliary lens 160 has a flat incident surface 160*a*, a curved internal reflective surface 160*b*, and a flat emission surface 160*c*.

The incident surface 160*a* is disposed facing the second light source 120 (each light source unit 120*a*) in the vertical direction. The light emitted from the second light source 120 passes through the incident surface 160*a* into the auxiliary lens 160. A portion of the light entering the auxiliary lens 160 through the incident surface 160*a* is transmitted to the internal reflective surface 160*b*, and the other portion (the remaining portion) is directly transmitted to the emission surface 160*c*.

Inside the auxiliary lens 160, the internal reflective surface 160*b* reflects a portion of the light entering through the incident surface 160*a* to the emission surface 160*c*. The internal reflective surface 160*b* is formed by subjecting the surface opposite to the internal reflective surface 160*b*, i.e., the external surface of the auxiliary lens 160 to a reflection treatment, such as vapor deposition of aluminum. The internal reflective surface 160*b* is a freeform surface based on an optical ellipse having a first focus in the vicinity of the second light source 120 and a second focus in the vicinity of the leading edge 150*a* of the shade 150 while refraction at the incident surface 160*a* is taken into consideration. The internal reflective surface 160*b* reflects a portion of the light entering through the incident surface 160*a* to the emission surface 160*c*. Note that the configuration of the internal reflective surface 160*b* is not limited to that of the second embodiment as long as the internal reflective surface 160*b* is reflective as described above. Alternatively, the internal reflective surface 160*b* may use, for example, total reflection without reflection treatment, or may have any other configuration.

The emission surface 160*c* faces the projection lens 170 in the optical axis direction and emits the other portion of the light to the outside of the auxiliary lens 160. The other portion of the light is the light reflected by the internal reflective surface 160*b* and the light that enters the incident surface 160*a* but not the internal reflective surface 160*b*. The emission surface 160*c* emits the light reflected by the internal reflective surface 160*b* to the projection lens 170. Therefore, the auxiliary lens 160 functions as a light guiding unit that guides a portion of the light emitted from the second light source 120 toward the projection lens 170. The emission surface 160*c* emits the other portion of the light entering the incident surface 160*a* to the reflective surface 150*b* of the shade 150. The other portion of the light travels to the projection lens 170 by being reflected by the reflective surface 150*b*.

The auxiliary lens 160 of the second embodiment is formed of a cylindrical lens extending in the width direction and having a refractive power only in the optical axis direction, to correspond to the five light source units 120*a* of the second light source 120. The auxiliary lens 160 is disposed on the heat sink member 130. The auxiliary lens 160 is one that has a focal line extending in the width direction along the five light source units 120*a*. Note that the configuration of the auxiliary lens 160 is not limited to that of the second embodiment as long as the auxiliary lens 160 functions as a light guiding unit that guides a portion of the light emitted from the second light source 120 toward the projection lens 170.

The projection lens 170 has the rear focal point set in the vicinity of the leading edge 150*a* of the shade 150. The projection lens 170 projects the light emitted from the first light source 110 and reflected by the reflective surface 220 of the reflector 140 forward from the vehicle, to form a passing light distribution pattern LP (see FIG. 5). The projection lens 170 also projects a portion of the light reflected by the internal reflective surface 160*b* of the auxiliary lens 160 and emitted from the second light source 120 forward from the vehicle, to form a traveling light distribution pattern HP (see FIG. 5). The projection lens 170 also projects the other portion of the light reflected by the reflective surface 150*b* of the shade 150 and emitted from the second light source 120 forward from the vehicle, to form an auxiliary light distribution pattern AP (see FIG. 5).

The projection lens 170 is supported by a lens holder. The lens holder is mounted to the heat sink member 130 while the projection lens 170 is positioned relative to the first light source 110, the second light source 120, the reflector 140, the shade 150, and the auxiliary lens 160

The vehicular lamp 100 appropriately lights the first light source 110 by supplying electric power from the lighting control circuit to the first light source 110 via the substrate 200. Upon this lighting, in the vehicular lamp 100, the light from the first light source 110 is reflected by the reflective surface 220 of the reflector 140 and projected by the projection lens 170, to form a passing light distribution pattern LP (see FIG. 5) having a cutoff line Cl at the upper edge.

The vehicular lamp 100 appropriately lights the second light source 120 (each of the light source units 120*a*) by supplying electric power from the lighting control circuit to each light source unit 120*a* of the second light source 120 via the substrate 210. Upon this lighting, in the vehicular lamp 100, a portion of the light from the second light source 120 enters the auxiliary lens 160 through the incident surface 160*a*, is reflected by the internal reflective surface 160*b*, is emitted from the emission surface 160*c* to the outside of the auxiliary lens 160, and travels to the projection lens 170. The vehicular lamp 100 then projects the light by the projection lens 170 and forms the traveling light distribution pattern HP (see FIG. 5) such that the lower edge portion of the traveling light distribution pattern HP overlaps with the upper edge portion of the passing light distribution pattern LP.

Moreover, in the vehicular lamp 100, the other portion of the light from the lit second light source 120 (each light source unit 120*a*) enters the auxiliary lens 160 through the incident surface 160*a*, is emitted to the outside of the auxiliary lens 160 from the emission surface 160*c*, and travels to the reflective surface 150*b* of the shade 150. In the vehicular lamp 100, the light is reflected by the reflective surface 150*b* to the projection lens 170 and projected by the projection lens 170, to form an auxiliary light distribution pattern AP (see FIG. 5) that overlaps with the substantial upper half of the traveling light distribution pattern HP and illuminate the traveling light distribution pattern HP and also the area above the traveling light distribution pattern HP. Note that configuration of the vehicular lamp 100 is not limited to that of the second embodiment. Alternatively, the vehicular lamp 100 may cause the other portion of the light from the second light source 120 to travel directly to the reflective surface 150*b* without entering the auxiliary lens 160 as long as an auxiliary light distribution pattern AP is formed by reflecting the light by the reflective surface 150*b* of the shade 150 and projecting the light by the projection lens 170.

The vehicular lamp 100 of the second embodiment is an adaptive driving beam (ADB). When the five light source units 120*a* of the second light source 120 are turned on, the light from the light source units 120*a* form respective traveling light distribution sections hp (see FIG. 5). The five traveling light distribution sections hp are integrally formed side by side in the width direction to form the traveling light distribution pattern HP (see FIG. 5). The vehicular lamp 100 individually turns on and off the light source units 120*a* of the second light source 120 to partially turn off the five traveling light distribution sections hp in a specific direction (See FIG. 6). As a result, the vehicular lamp 100 can partially turn off the traveling light distribution pattern HP in any direction by individually turning on and off the light source units 120*a*.

At this time, with the vehicular lamp 100 of the second embodiment, even when the traveling light distribution pattern HP is partially turned off in a specific direction, the auxiliary light distribution pattern AP, which is formed so as to overlap with the substantial upper half of the traveling light distribution pattern HP, is not partially turned off. This is because the reflective surface 150*b* is formed by surface-treating the lower surface of the shade 150 of the vehicular lamp 100, and the auxiliary light distribution pattern AP is not formed by separate portions corresponding to the light source units 120*a*, such as in the traveling light distribution pattern HP, which is formed by the traveling light distribution sections hp. As a result, with the vehicular lamp 100, even when the traveling light distribution pattern HP is partially turned off, the auxiliary light distribution pattern AP can be left above the traveling light distribution pattern HP. In this way, uncomfortable feelings experienced by the passenger can be suppressed. Note that the configuration of the vehicular lamp 100 is not limited to that of the second embodiment, and the auxiliary light distribution pattern AP may be formed by separate portions corresponding to the light source units 120*a*, as in the traveling light distribution sections hp of the traveling light distribution pattern HP.

Figure 5:
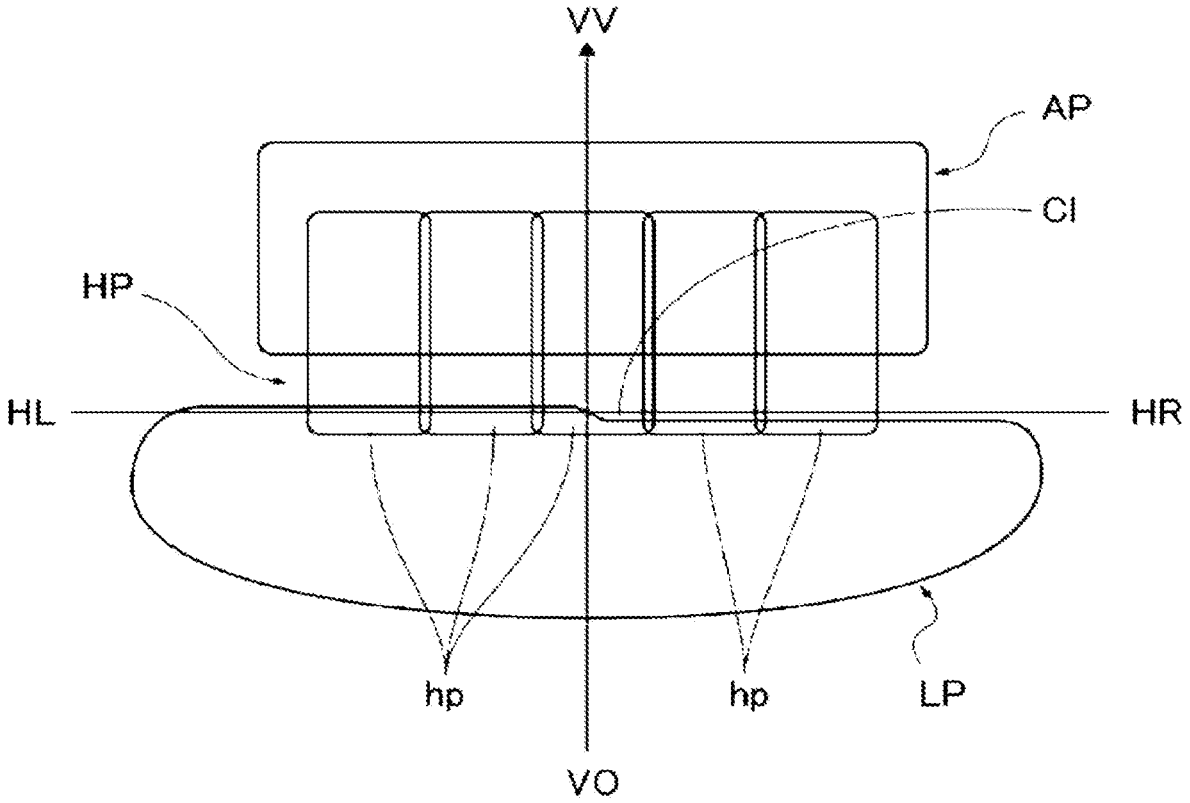
FIG. 5 is a diagram illustrating a traveling light distribution pattern and a passing light distribution pattern of the example in FIG. 4.
Figure 6:
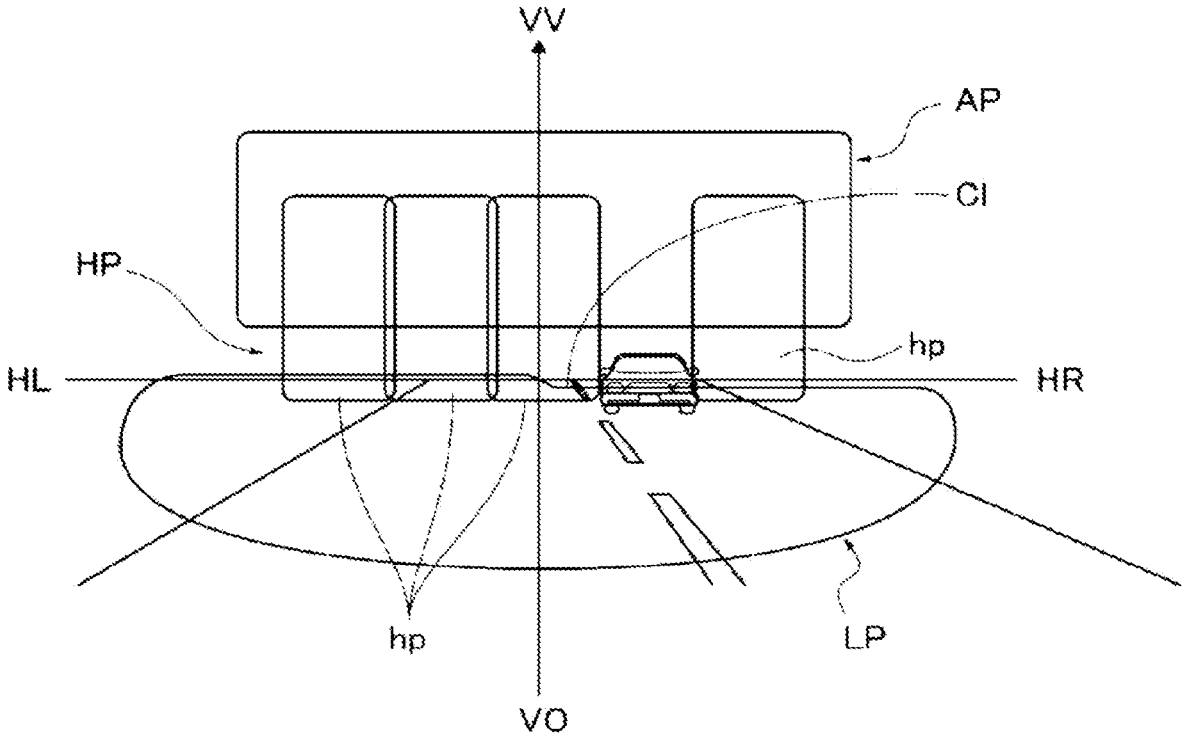
FIG. 6 is a diagram similar to FIG. 5 illustrating a state in which one of a traveling light distribution sections is turned off in a traveling light distribution pattern of the example in FIG. 4.

Consequently, the vehicular lamp 100 can form the passing light distribution pattern LP having the cutoff line Cl by turning on the first light source 110 and form the traveling light distribution pattern HP and auxiliary light distribution pattern AP by turning on the light source units 120*a* of the second light source 120 (see FIG. 5). The vehicular lamp 100 performs the lighting control of the first light source 110 and each of the light source units 120*a* of the second light source 120, to appropriately form at least one of the passing light distribution pattern LP, the traveling light distribution pattern HP, and the auxiliary light distribution pattern AP. The vehicular lamp 100 turns off a light source unit 120*a* residing in any direction among the light source units 120*a* of the second light source 120 and thereby a traveling light distribution section hp in the corresponding direction is not formed. In this way, the vehicular lamp 100 can realize the function of the ADB (see FIG. 6).

In this way, in the vehicular lamp 100, the auxiliary lens 160 disposed above the second light source 120 guides only a portion of the light emitted from the second light source 120 to the projection lens 170, and the other portion of the light emitted from the second light source 120 is reflected by the reflective surface 150*b* of the shade 150 and transmitted to the projection lens 170. Therefore, the vehicular lamp 100 does not need to reflect all the light from the second light source 120 toward the projection lens 170 like the translucent member according to the conventional art. Accordingly, the configurations of the incident surface 160*a*, the internal reflective surface 160*b*, and the emission surface 160*c* and the emission surface 160*c* of the auxiliary lens 160 can be minimized, and the auxiliary lens 160 can be small. Here, the phase "all of the light from the second light source 120" refers to the light emitted from the second light source 120 that exceeds predetermined intensity and is controlled to form predetermined light distribution patterns. As a result, in the vehicular lamp 100, even when the second light source 120 is disposed at the same position (on the same plane) in the vertical direction as the first light source 110, the auxiliary lens 160 can be prevented from hindering the advancement of the light emitted from the first light source 110 and reflected to the projection lens 170 by the reflector 140. Therefore, in the vehicular lamp 100, the area in which the first light source 110 and the second light source 120 are attached (the upper surface 130*a* in the second embodiment) can be made flat; the member to which the first light source 110 and the second light source 120 are attached (the heat sink member 130 in the second embodiment) can be made to have a simple shape; and the first light source 110 and the second light source 120 can be disposed on the same plane. Note that, the substrate 200 and the substrate 210, which are disposed on the upper surface 130*a* on the same plane, may be integrated into a single substrate.

In particular, in the vehicular lamp 100 of the second embodiment, the first light source 110 and the second light source 120 are attached to the heat sink member 130 via the substrate 200 and the substrate 210, respectively. In general, heat is transferred radially from a heat source in a heat sink. Therefore, the cooling capability of the heat sink can be enhanced if it includes a large-volume spherical portion that is concentric with the heat source. In the vehicular lamp 100, the upper surface 130*a* of the heat sink member 130 is flat. Therefore, compared to when the upper surface 130*a* has a step-like structure, large-volume concentric spherical portions can be readily provided below the first light source 110 and the second light source 120 without any missing parts due to the step-like structure. Consequently, the heat sink member 130 of the vehicular lamp 100 can have a sufficient volume for transferring heat from both the first light source 110 and the second light source 120. In this way, the first light source 110 and the second light source 120 can be appropriately cooled.

In the vehicular lamp 100, the leading edge 150*a* of the shade 150 is tapered, and the auxiliary lens 160 is disposed in the vicinity of the shade 150. Therefore, in the vehicular lamp 100, the optical path forming the passing light distribution pattern LP and the optical path forming the traveling light distribution pattern HP can be set in the vicinity of the rear focal point of the projection lens 170. As a result, the passing light distribution pattern LP and the traveling light distribution pattern HP can be formed in an overlapping manner.

The vehicular lamp 100 of the second embodiment can achieve each of the following effects.

In the vehicular lamp 100, a portion of the light emitted from the second light source 120 is guided toward the projection lens 170 by the auxiliary lens 160 serving as a light guiding unit, and the other portion of the light emitted from the second light source 120 is reflected toward the projection lens 170 by the shade 150 disposed above the auxiliary lens 160. Therefore, in the vehicular lamp 100, the light emitted from the second light source 120 is transmitted to the projection lens 170 by both the auxiliary lens 160 and the shade 150. As a result, in the vehicular lamp 100, the auxiliary lens 160 can be small, and even when the first light source 110 and the second light source 120 are disposed at the same position (on the same plane) in the vertical direction, the auxiliary lens 160 can prevented from hindering the advancement of the light emitted from the first light source 110 and reflected to the projection lens 170 by the reflective surface 220. As a result, in the vehicular lamp 100, the member to which the first light source 110 and the second light source 120 are attached can have a simple shape. In the vehicular lamp 100, the first light source 110 and the second light source 120 may alternatively be disposed on a common substrate in which the substrate 200 and the substrate 210 are integrated.

In the vehicular lamp 100, the first light source 110 and the second light source 120 are disposed on the upper surface 130*a* of the heat sink member 130. Consequently, the upper surface 130*a* does not have to have a step-like structure, and thus the vehicular lamp 100 can appropriately cool the first light source 110 and the second light source 120.

In the vehicular lamp 100, the projection lens 170 projects the light guided by the auxiliary lens 160 forward in the optical axis direction to form the traveling light distribution pattern HP above the passing light distribution pattern LP, and projects the light reflected forward in the optical axis direction by the reflective surface 150*b* of the shade 150 to form the auxiliary light distribution pattern AP above the traveling light distribution pattern HP so that the auxiliary light distribution pattern AP overlaps with the substantial upper half of the traveling light distribution pattern HP. Therefore, the vehicular lamp 100 can set the optical path forming the traveling light distribution pattern HP and the optical path forming the auxiliary light distribution pattern AP in the vicinity of the shade 150 (the leading edge 150*a*), i.e., the optical path forming the passing light distribution pattern LP. In this way, the vehicular lamp 100 can form the passing light distribution pattern LP and the traveling light distribution pattern HP in an overlapping manner and form the auxiliary light distribution pattern AP to overlap with the traveling light distribution pattern HP.

In the vehicular lamp 100, the light from the light source units 120*a* of the second light source 120 form respective traveling light distribution sections hp aligned in the width direction to form the traveling light distribution pattern HP. Therefore, in the vehicular lamp 100, the light source units 120*a* of the second light source 120 are appropriately cooled and individually turned on and off, to selectively turn off a traveling light distribution section hp in a specific direction among the multiple traveling light distribution sections hp. This realizes a more appropriately ADB function.

The vehicular lamp 100 includes the auxiliary lens 160 that is a light guiding unit formed of a light transmissive member transmits a portion of the light emitted from the second light source 120. Therefore, the vehicular lamp 100 has a simple configuration that transmits a portion of the light emitted from the second light source 120 to the auxiliary lens 160 and be guided toward the projection lens 170.

Therefore, the vehicular lamp 100 of the second embodiment serving as a vehicular lamp 100 according to the disclosure can form the passing light distribution pattern LP and the traveling light distribution pattern HP in an overlapping manner while the first light source 110 and the second light source 120 are disposed without a difference in level.

Although the vehicular lamp of the disclosure has been described on the basis of the second embodiment, the specific configuration is not limited to that of the second embodiment, and design changes and additions are allowed without deviation from the gist of the invention according to each claim of the invention.

Note that, in the second embodiment, the ADB function can be realized by not forming a certain traveling light distribution section hp in the traveling light distribution pattern HP. However, the configuration of the vehicular lamp 100 is not limited to that of the second embodiment as long as the passing light distribution pattern LP is formed of the light from the first light source 110 reflected by the reflector 140 and projected by the projection lens 170, and the traveling light distribution pattern HP is formed of the light from the second light source 120 guided by the light guiding unit and projected by the projection lens 170.

In the second embodiment, the light guiding unit includes the auxiliary lens 160 formed of a light transmissive member that transmits a portion of the light emitted from the second light source 120. However, the configuration of the light guiding unit is not limited to that of the second embodiment as long as the light guiding unit (160) guides a portion of the light emitted from the second light source 120 toward the projection lens 170. In another example, the light guiding unit can be formed of a reflective member, such as a mirror, that reflects a portion of the light emitted from the second light source 120. In such a case, the light guiding unit (the reflective member) can have only a reflective surface like the internal reflective surface 160*b*. Consequently, the light guiding unit can have a simpler configuration, and a simpler optical setting because the other portion of light emitted from the second light source 120 can be directly transmitted to the shade 150 (the reflective surface 150*b*) without passing through the incident surface 160*a* and the emission surface 160*c*.

In the second embodiment, the auxiliary lens 160 is a cylindrical lens. However, the configuration of the auxiliary lens 160 is not limited to that of the second embodiment as long as the auxiliary lens 160 corresponds to the multiple (five in the second embodiment) light source units 120*a* of the second light source 120. In another example, multiple lenses corresponding to the respective light source units 120*a* may be provided, or a freeform lens having incident surfaces and emission surfaces designed for the respective light source units 120*a* may be provided. Individual freeform lenses may be provided for the respective light source units 120*a*, or an integrated single freeform lens corresponding to the respective light source units 120*a* may be provided.

10, 100 vehicular lamp
11, 110 first light source
12, 120 second light source
12*a*, 120*a* light source unit
14, 140 reflector
16 first lens
17 second lens

22 first reflective surface
23 second reflective surface
24 lower lens surface
25 upper lens surface
150 shade
160 auxiliary lens (as an example of a light guiding unit)
170 projection lens
HP traveling light distribution pattern
hp traveling light distribution section
LP passing light distribution pattern
AP auxiliary light distribution pattern
Cl cutoff line

The invention claimed is:

1. A vehicular lamp comprising:
a first light source that emits light forming a passing light distribution pattern;
a second light source that is disposed forward of the first light source in an optical axis direction and emits light forming a traveling light distribution pattern;
a reflector that reflects the light emitted from the first light source and the second light source;
a first lens that projects the light reflected forward in the optical axis direction by the reflector; and
a second lens that transmits the light emitted from the second light source toward the reflector, wherein,
the second light source is disposed on the same plane as the first light source, and
the reflector has a first reflective surface and a second reflective surface, the first reflective surface reflecting the light emitted from the first light source to the first lens, the second reflective surface being disposed forward of the first reflective surface in the optical axis direction and reflecting the light emitted from the second light source through the second lens to the first lens.

2. The vehicular lamp according to claim 1, wherein the first lens has a lower lens surface in which light reflected by the first reflective surface enters and an upper lens surface in which light reflected by the second reflective surface enters.

3. The vehicular lamp according to claim 1, wherein,
in the second light source, a plurality of light source units is aligned in a width direction orthogonal to the optical axis direction and a vertical direction, and
the traveling light distribution pattern includes a plurality of traveling light distribution sections aligned in the width direction, each of the traveling light distribution sections being formed by light from a corresponding one of the light source units projected by the first lens, each of the light distribution sections being able to be turned on and off.

4. The vehicular lamp according to claim 3, wherein the second lens includes a cylindrical lens extending in the width direction and having a refractive power only in the optical axis direction.

5. A vehicular lamp comprising:
a first light source that emits light forming a passing light distribution pattern;
a second light source that is disposed forward of the first light source in an optical axis direction and emits light forming a traveling light distribution pattern;
a reflector that reflects the light emitted from the first light source;
a projection lens that projects the light reflected by the reflector forward in an optical axis direction to form the passing light distribution pattern;
a shade that blocks a portion of light reflected by the reflector to form a cutoff line in the passing light distribution pattern; and
a light guiding unit that is disposed below the shade and guides a portion of the light emitted from the second light source toward the projection lens, wherein,
the second light source is disposed on the same plane as the first light source, and
the shade reflects another portion of the light emitted from the second light source toward the projection lens.

6. The vehicular lamp according to claim 5, wherein the projection lens projects the light guided by the light guiding unit forward in the optical axis direction to form the traveling light distribution pattern above the passing light distribution pattern, and projects the light reflected by the shade forward in the optical axis direction to form an auxiliary light distribution pattern above the traveling light distribution pattern.

7. The vehicular lamp according to claim 5, wherein,
in the second light source, a plurality of light source units is aligned in a width direction orthogonal to the optical axis direction and a vertical direction, and
the traveling light distribution pattern includes a plurality of traveling light distribution sections aligned in the width direction, each of the traveling light distribution sections being formed by light from a corresponding one of the light source units projected by the projection lens, each of the light distribution sections being able to be turned on and off.

8. The vehicular lamp according to claim 5, wherein the light guiding unit comprises a light transmissive member that transmits a portion of the light emitted from the second light source.

9. The vehicular lamp according to claim 5, wherein the light guiding unit comprises a reflective member that reflects a portion of the light emitted from the second light source.

* * * * *